United States Patent [19]

Yamanari et al.

[11] Patent Number: 4,967,660

[45] Date of Patent: Nov. 6, 1990

[54] SHEET-FED ROTARY PRINTING PRESS FOR BOTH OBVERSE AND REVERSE SIDE PRINTING

[75] Inventors: Hiroshi Yamanari; Yusaku Kitamura; Nobuhiko Fujisawa, all of Fuchu, Japan

[73] Assignee: Ryobi Ltd., Hiroshima, Japan

[21] Appl. No.: 375,803

[22] Filed: Jul. 5, 1989

[30] Foreign Application Priority Data

Jul. 6, 1988 [JP] Japan ..... 63-90309[U]

[51] Int. Cl.[5] ..... B41F 5/02

[52] U.S. Cl. ..... 101/229; 101/231; 101/183

[58] Field of Search ..... 101/177, 183, 184, 217, 101/229, 230, 231

[56] References Cited

U.S. PATENT DOCUMENTS 3,049,996 8/1962 Downie ..... 101/217
3,334,897 8/1967 Sharkey ..... 101/217
4,409,895 10/1983 Fischer ..... 101/248
4,471,695 9/1984 Ishii .
4,621,576 4/1986 Wirz .
4,777,876 10/1988 Ishii ..... 101/177

OTHER PUBLICATIONS

U.S. application Ser. No. 97/225,642, Hiroshi Yamanari and Nobuhiko Fujisawa, filed Jul. 27, 1988, "Reverse Side Printing Device Employing Sheet Feed Cylinder and Provided in Sheet-Fed Printer".

*Primary Examiner*—Edgar S. Burr
*Assistant Examiner*—Ren Yan
*Attorney, Agent, or Firm*—Sughrue, Mion, Zinn, Macpeak and Seas

[57] ABSTRACT

A sheet-fed rotary printing press for printing both the obverse and reverse side of a printing sheet. The printing press is provided with at least one obverse side printing unit including an impression cylinder and a discharge cylinder in contact therewith. The printing press is also provided with a reverse side printing unit in confrontation with the discharge cylinder. The discharge cylinder also functions as an impression cylinder for the reverse side printing.

2 Claims, 2 Drawing Sheets

SHEET-FED ROTARY PRINTING PRESS FOR BOTH OBVERSE AND REVERSE SIDE PRINTING

BACKGROUND OF THE INVENTION

The present invention relates to a sheet-fed rotary printing press for effecting printings to both obverse and reverse sides of a cut sheet.

Conventional two-sided printing machines have been classified into two types. In the first type of printing machine, a cut sheet is conveyed between an obverse side printing unit and a reverse side printing unit, so that dual side printings can be simultaneously achieved. More specifically, U.S. Pat. No. 4,471,695 commonly assigned to Ryobi Ltd. (corresponding to Japanese Patent Application Kokai No. 58-25961) discloses the two-sided printing machine in which two blanket cylinders are in rolling contact with each other, and one of the blanket cylinders of the obverse side printing unit serves as an impression cylinder for reverse side printing, and the other blanket cylinder of the reverse side printing unit serves as an impression cylinder for the obverse side printing. Further, copending U.S. patent application Ser. No. 225,642 filed on Jul. 27, 1988 (corresponding to Japanese Patent Application Kokai No. 62-102532) discloses a double-sided printing machine in which a sheet-feed cylinder is in rolling contact with an impression cylinder of the obverse side printing unit, and the sheet-feed cylinder serves as an impression cylinder for the reverse side printing.

In the second type of printing machine, tandem printing is achieved in such a manner that obverse side printing is first carried out, and then the sheet is turned over for performing the reverse side printing as described in U.S. Pat. No. 4,621,576 assigned to Heidelberger Druckmaschinen AG (corresponding to Japanese Patent Application Kokai No. 60-255434). In the second type, multi-color printing is of convertible type for effecting multi-color printing on the specific side of the printing sheet, and a sheet transfer cylinder is provided with a sheet turnover mechanism.

According to the first type of printing machine in which the opponent blanket cylinder functions as the impression cylinder and vice versa, sufficient printing pressure cannot be applied to the printing sheet, since the blanket cylinder is formed of an elastic material such as a rubber. When the sheet pressedly passes through the blanket cylinders, these cylinders may be elastically deformed, to thereby degrade printing pressure, to thus render an output image which is degraded. In this connection, this type of printing machine has been exclusively used for both-sided printing with a single color such as character printing and line-image printing. Further, due to unwanted elastic deformations, the confronting blanket cylinders cannot exclude two sheets superposedly supplied thereto. As a result, the two sheets are overlappingly subjected to printings.

In case of the printing machine in which the sheet-feed cylinder serves as the impression cylinder for the reverse side printing according to another first type printing machine, it would be almost impossible to provide a sufficient space for installing a sheet infeeding mechanism such as a swing type sheet feeding mechanism, since the reverse side printing unit must be installed at a positon below the sheet-feed cylinder, the reverse side printing unit including a blanket cylinder, a plate cylinder and inking and dampening units. With such spacial limitation, a simple paper feeding mechanism such as an infeed roller the only available, option and therefore, the resultant printing machine is not capable of high speed, high accuracy printing, and sheet size may be restricted in the printing machine.

According to the second type of printing machine, the sheet turnover mechanism is of complicated construction and complicated operation may be required. Accordingly, high dimensional accuracy is required in the overall apparatus. Further, for the turnover operation to the sheet, sheet is regripped, and therefore, the gripped sheet position may be changed to thereby lower print positional registration. As a result, high quality output image may not be obtainable. Furthermore, in the sheet turnover operation, since the sheet end portion is regripped, cutting of the sheet stack requires high accuracy. Therefore, available sheet size may undergo restriction.

SUMMARY OF THE INVENTION

It is therefore, an object of the present invention to overcome the above-described drawbacks and disadvantages, and to provide an improved sheet-fed rotary printing press for both sided-printings.

Another object of this invention is to provide such improved sheet-fed press having simple mechanical construction which does not require intricate printing operation, yet providing highly accurate output printing images on both obverse and reverse sides of the printing sheet.

Still another object of this invention is to provide such sheet-fed press which facilitates print positional registration with surely providing a single sheet feeding to the sheet printing area.

In the technical trend of this field, there has been a proposal in an attempt to dispense with a sheet discharge cylinder, since the sheet discharge cylinder may consider to do damage to the imaging surface of the printing sheet. Such attempt has been made in Japanese Patent Publication No. 47-30483 and Japanese Patent Application Kokai No. 58-25961. However, in the present invention, the sheet discharge cylinder is positively used for realization of various advantages.

Briefly, and in accordance with the present invention, there is provided a sheet-fed rotary printing press for printing both obverse and reverse side of a printing sheet, comprising: an obverse side printing unit comprising a first inking unit, a first plate cylinder, a first blanket cylinder, an impression cylinder, a paper discharge cylinder formed with a recessed portion, the impression cylinder being provided with at least one gripping unit, a paper discharge unit having an endless chain, at least one gripper mounted on the endless chain, the gripper being movable into and out of the recessed portion in synchronism with a rotation of the paper discharge cylinder, the gripper gripping the printing sheet when the gripping unit of the impression cylinder releases the printing sheet, and a reverse side printing unit comprising a second inking unit, a second plate cylinder, a second blanket cylinder and a second impression cyinder, the paper discharge cylinder of the obverse side printing unit being compatible with the second impression cylinder of the reverse side printing unit.

DETAILED DESCRIPTION OF THE PREFERRED EMBODIMENTS

Figure 1:
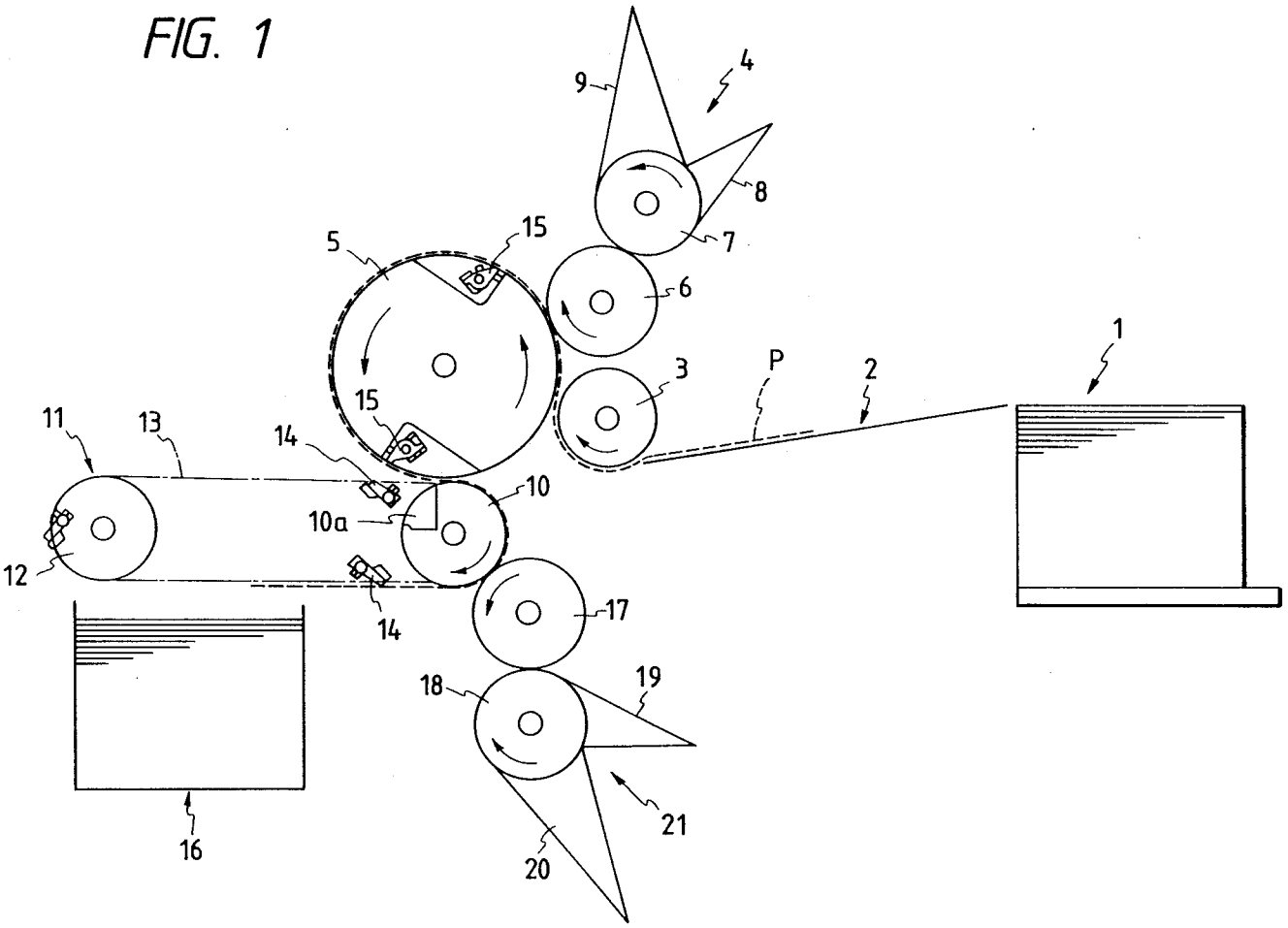
FIG. 1 is a schematic illustration showing a plurality of a cylinder array used in a sheet-fed printing press for both obverse and reverse sides printings according to a first embodiment of this invention.

A first embodiment according to this invention will be described with reference to FIG. 1. This embodiment realizes a single color printing at an obverse side and a single color printing at a reverse side of a printing sheet. A printing machine as shown includes a paper supply section 1, a paper insertion section 2 having a known feeder board (not shown), where a front positional alignment is effected by a front guide (not shown). A paper feed cylinder 3 is connected to the paper insertion section 2 by way of a known kick-in roller or a swinging mechanism (not shown). Further, a obverse side printing unit 4 and a reverse side printing unit 21 are provided at positions adjacent an impression cylinder 5. At position downstream of these units, paper discharge section 11 is provided, and a paper discharge table 16 is disposed below the discharge section 11.

In the obverse side printing section 4, there are provided a plate cylinder 7, an inking unit 9, a dampening unit 8, a blanket cylinder 6, the impression cylinder 5 and a discharge cylinder 10. In modification, instead of the single impression cylinder 5, a satellite type multicolor printing machine can be provided by employing a plurality of blanket cylinders, plate cylinders, dampening units and inking units. In another modification, the paper feed cylinder 3 can be dispensed with by transferring a paper P from the guide portion directly to the impression cylinder 5 by using an upper swinging mechanism (not shown).

In the illustrated embodiment, a diameter of the impression cylinder 5 doubles that of the paper feed cylinder 3, the blanket cylinder 6, the plate cylinder 7 and the discharge cylinder 10. However, the diameter of the impression cylinder 5 can be equal to those of the rollers or triple or four times as large as that of the rollers.

In the discharge section 10, an endless chain 13 is mounted over a sprocket 12 and another sprocket (not shown) rotatably provided coaxial with the discharge cylinder 10. Further, a predetermined numbers of paper grippers 14 are provided on the endless chain 13.

The impression cylinder 5 is provided with sheet gripping units 15 for gripping end portion of the paper P. The gripping units 15 provide open and close state for releasing and gripping the paper. Further, the discharge cylinder 10 is formed with a recess 10*a* into which the gripper 14 can be inserted in synchronism with the rotation of the discharge cylinder 10. Upon opening of the gripping unit 15, the gripper 14 gripps the printed paper P at the discharge cylinder 10 for transferring the printed paper P onto the discharge table 16. In this connection, the discharge cylinder 10 also functions as a guide member for guiding travel of the printed paper along to the discharge section 11.

In the present invention, attention is drawn to the utility of the discharge cylinder 10 for imparting the printing machine with multi-functions. More specifically, in the present invention, the discharge cylinder 10 also serves as an impression cylinder in the reverse side printing unit 21. The reverse side printing unit 21 includes the discharge/impression cylinder 10, a second blanket cylinder 17 in rolling contact with the cylinder 10, a second plate cylinder 18 in contact with the cylinder 17, a second inking section 20 and a second dampening section 19. When the paper P is transferred from the impression cylinder 5 to the gripper 14, a reverse side of the paper P is brought into contact with the blanket cylinder 17, so that the reverse side printing is effected. In this case, the obverse side of the paper P is in contact with the discharge cylinder 10, i.e., the impression cylinder 10 in the reverse side printing unit 21.

In operation, the paper P from the paper supply section 1 is delivered onto the feeder board of the paper insertion section 2, so that front positional alignment is made. The paper P is then delivered, by the kick-in roller or the swinging mechanism into the gripping unit 15 of the impression cylinder 5 by way of the paper feed cylinder 3. The thus gripped paper is travelled between the impression cylinder 5 and the blanket cylinder 6, so that a obverse side printing is carried out.

The paper P is then released from the impression cylinder 5 when the gripping unit 15 is opened. In this case, the gripper 14 mounted on the endless chain 13 is moved into the recessed portion 10*a* of the discharge cylinder 10 in synchronism with the rotation thereof for again gripping the paper P by the gripper 14. The thus gripped paper P is travelled toward the paper discharge section 16. However, on its way to the discharge section 16, the paper P is travelled between the discharge cylinder 10 now also functioning as the impression cylinder and the second blanket cylinder 17 of the reverse side printing unit 21. As a result, reverse side printing is conducted. The paper P subjected to dual sides printing reaches the discharge section 16 and the gripper releases the paper P at a position above the table 16.

Figure 2:
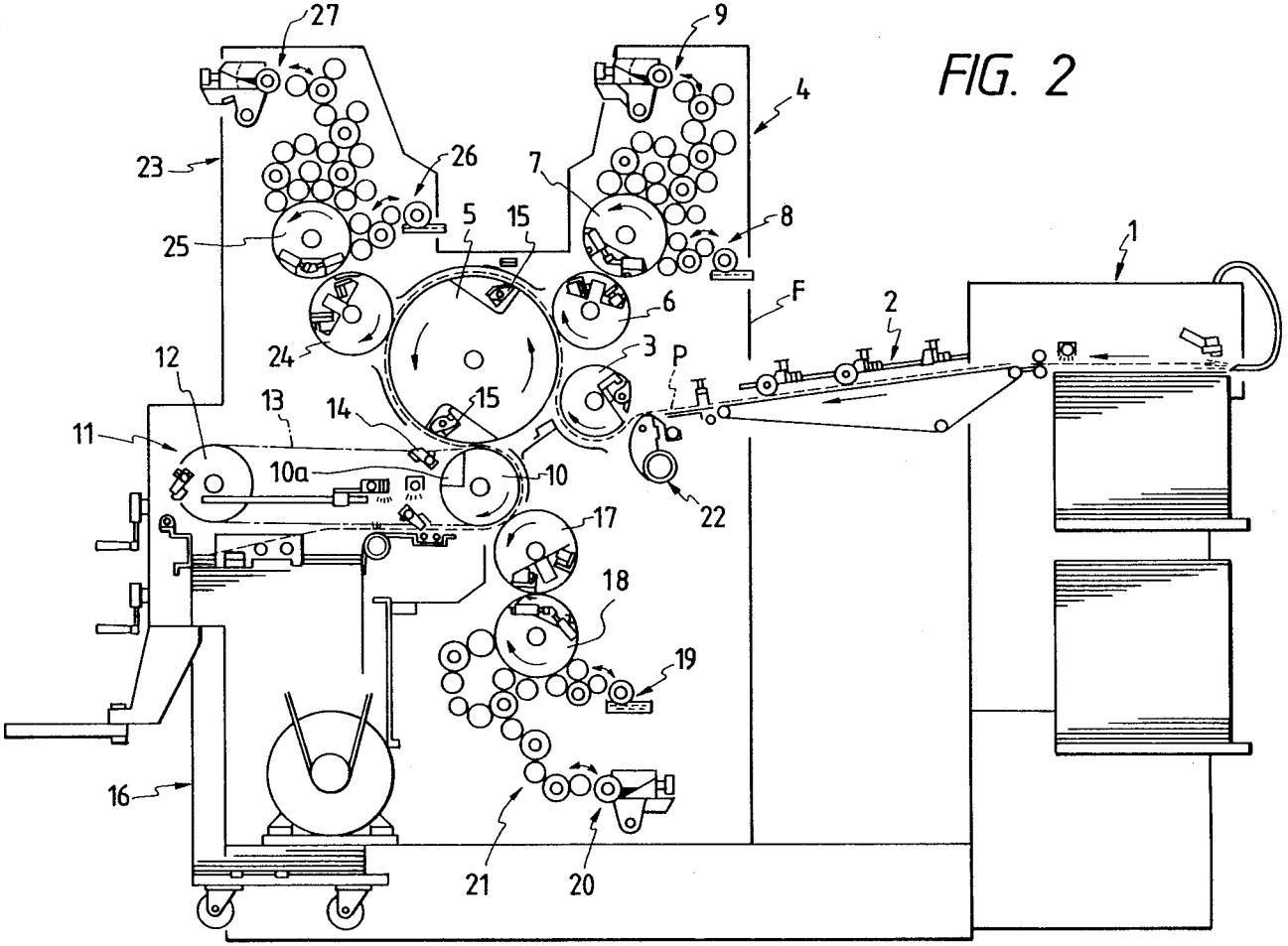
FIG. 2 is a schematic cross-sectional side view showing an overall sheet-fed printing press which incorporates a both sided printing device according to a second embodiment of this invention.

A second embodiment according to this invention will be described with reference to FIG. 2 wherein like parts and components are designated by the same reference numerals and characters as those shown in FIG. 1. The embodiment shown in FIG. 2 delineates an overall printing apparatus showing an external frame F. This embodiment pertains to double color printing at an obverse side and a single color printing at a reverse side of a paper P.

As shown, large space can be provided around the paper feed cylinder 3. Therefore, a lower swinging mechanism 22 can be installed within the frame F. Further, a second obverse side printing unit 23 is provided which includes a blanket cylinder 24, plate cylinder 25, a dampening unit 26 and an inking unit 27, those being similar to the first obverse side printing unit 4. Therefore, two colors can be applied to the obverse side of the paper P. Furthermore, in the second embodiment, the discharge roller 10 serves as an imprssion cylinder for the reverse side printing in a manner similar to that of the first embodiment.

In the above described embodiments, various printing modes are attainable, such as a single color printing at the obverse side, two color printing at the obverse side, single color printing at both obverse and reverse sides, and two color printing at the obverse side and a single color printing at the reverse side. Such printing mode can be easily modified by moving one of the cylinders toward and away from the opponent cylinder with mere manipulation of a known lever or push button without employment of a known turnover mechanism. Such printing is carried out in travelling the paper P by normally gripping paper edge portion (leading edge portion) of the paper P. Therefore, sufficient sheet positional alignment is maintainable.

As described above, according to the present invention, blanket cylinder in the opponent group is not used as an impression cylinder, but the cylinder 5 and a rigid discharge cylinder 10 are utilized as inherent impression cylinders. Therefore, dual sheet feeding can be eliminated and high quality output images are provided at both obverse and reverse sides of the printing paper.

Further, in the present invention, since the discharge cylinder 10 is compatible with the impression cylinder for the reverse side printing, simplified printing machine results. This is in high contrast to the conventional machine using an intricate sheet turnover mechanism where the complicated turnover operation has been required, and high mechanical dimension accuracy has been required due to complex structure, to thereby lower and degrade the stability in paper positional alignment. On the other hand, in the present invention, high quality output images are obtainable even at reverse side of the printing paper without any turnover operation and without degradation of the printing quality and accuracy with respect to the obverse side.

While the invention has been described and with reference to the specific embodiments, it would be apparent for those skilled in the art that various changes and modifications can be made therein without departing from the spirit and scope of the invention.

What is claimed is:

1. A sheet-fed rotary printing press for sequentially printing the obverse and reverse sides of a printing sheet, comprising:

an obverse side printing unit comprising a first inking unit, a first plate cylinder, a first blanket cylinder, a first impression cylinder, and a paper discharge cylinder formed with a recessed portion, the impression cylinder being provided with at least one gripping unit;

a paper discharge unit having an endless chain;

at least one gripper mounted on the endless chain, the gripper being movable into and out of the recessed portion in synchronism with rotation of the paper discharge cylinder, said gripper gripping the printing sheet when the gripping unit of the first impression cylinder releases the printing sheet; and a reverse side printing unit comprising a second inking unit, a second plate cylinder, a second blanket cylinder and a second impression cylinder, the paper discharge cylinder of the obverse side printing unit serving as said second impression cylinder of the reverse side printing unit.

2. The sheet-fed rotary printing press as claimed in claim 1, further comprising a second obverse side printing unit, the second obverse side printing unit comprising a third inking unit, a third plate cylinder, a third blanket cylinder and the first impression cylinder, of the first obverse side printing unit.

* * * * *